United States Patent [19]

Egashira

[11] Patent Number: 4,790,526

[45] Date of Patent: Dec. 13, 1988

[54] METHOD AND APPARATUS FOR CONTROLLING THE ROTATION OF A BILL ACCUMULATING WHEEL

[75] Inventor: Masaaki Egashira, Urawa, Japan

[73] Assignee: Laurel Bank Machines Co. Ltd., Tokyo, Japan

[21] Appl. No.: 70,158

[22] Filed: Jul. 2, 1987

Related U.S. Application Data

[63] Continuation of Ser. No. 786,488, Oct. 11, 1985, abandoned.

[30] Foreign Application Priority Data

Nov. 6, 1984 [JP] Japan ..... 59-233674

[51] Int. Cl.[4] ..... B65H 29/20

[52] U.S. Cl. ..... 271/315; 271/187

[58] Field of Search ..... 271/69, 176, 178, 179, 271/184, 185, 186, 187, 314, 315

[56] References Cited

U.S. PATENT DOCUMENTS

| | | | |
|---|---|---|---|
| 1,949,152 | 2/1934 | Fankboner | 271/315 |
| 3,512,771 | 5/1970 | Dempsey et al. | 271/187 X |
| 3,531,108 | 9/1970 | Rabinow et al. | 271/305 |
| 3,719,267 | 3/1973 | Reist et al. | 271/270 |
| 4,088,314 | 5/1978 | Phillips | 271/178 X |
| 4,244,565 | 1/1981 | Geier | 271/176 |
| 4,638,993 | 1/1987 | Granzow et al. | 271/315 |

FOREIGN PATENT DOCUMENTS

| | | | |
|---|---|---|---|
| 56-65757 | 6/1981 | Japan . | |
| 8300136 | 1/1983 | PCT Int'l Appl. | 271/315 |

OTHER PUBLICATIONS

R. A. Phillips, "Synchronous Stacking Device", 15934, Research Disclosure, pp. 60–62 (Jul. 1977).

*Primary Examiner*—Joseph J. Rolla
*Assistant Examiner*—Edward S. Ammeen
*Attorney, Agent, or Firm*—Fleit, Jacobson, Cohn & Price

[57] ABSTRACT

A bill accumulating wheel is disposed downstream of a bill conveying passage. A sensor detects the passage of the bill through a predetermined position in the conveying passage and a sensor generates a signal indicating the passage of each blade of the accumulating wheel through a predetermined position. The accumulating wheel is driven at a speed calculated by data obtained from the sensors so that the bill does not collide against the blade of the accumulating wheel.

5 Claims, 8 Drawing Sheets

METHOD AND APPARATUS FOR CONTROLLING THE ROTATION OF A BILL ACCUMULATING WHEEL

This application is a continuation of application Ser. No. 786,488, filed Oct. 11, 1985, abandoned.

BACKGROUND OF THE INVENTION

This invention relates to a method and appatus for controlling an accumulating wheel which is used for accumulating bills in an automatic depositing and dispensing machine or the like, and more particularly to a method and apparatus for preventing collision between a bill and blades of the accumulating wheel.

An accumulating wheel has a function of accumulating and arranging bills in a storage section after receiving between a plurality of blades each bill intermittently sent from a conveying mechanism comprising a belt conveyor or the like. A large number of such accumulating wheels are used in bank machines for handling bank notes, such as in automatic teller machines, etc. In a conventional accumulating wheel, in order to positively feed a bill in between the blades and prevent collision between the bill and blades, the rotation of the blades is controlled, for instance, by a method as disclosed in Japanese Patent Public Disclosure No. 65757/1981.

FIG. 10 is a diagram showing the relationship between the position of a bill and the rotating angle of the accumulating wheel in a case where the aforementioned controlling method is employed. In other words, assuming that a bill enters between the blades of the accumulating wheel at a time (point * in FIG. 10), after a lapse of a fixed time Tx from a time (point x in FIG. 10) at which the bill has passed a specific position in the conveying passage in the machine, the rotating angles of the accumulating wheel at the time when a sensor detects the bill passing the specific position in the conveying passage are classified into the following: safe timings $Ts_1$, $Ts_2$, $Ts_3$, . . . at which the advancing direction of a bill does not intersect a blade of the accumulating wheel at the time (point ◎ in FIG. 10) when the bill is expected to enter the rotating range of the accumulating wheel; risky timings $Td_1$, $Td_2$, . . . before and after intersecting timings $Tc_1$, $Tc_2$, . . . at which the advancing direction of the bill intersects the tip of a blade of the accumulating wheel; and intermediate timings $Tn_1$, $Tn_2$, $Tn_3$, $Tn_4$, . . . which cannot be judged to fall under either of the two categories just mentioned.

In a case where the point x in FIG. 10 falls under the category of dangerous timings (the two cases of 1 and 2 in FIG. 10), the timing (the point ◎ in FIG. 10) of entry of a bill is shifted to the next safe timing $Ts_3$ by speeding up the rotating speed of the accumulating wheel over a fixed time Ty (the time from the poing * up to the point ◎). In other words, according to this controlling method, a dangerous timing is prevented by increasing the speed of the accumulating wheel above its normal rotation speed (a low speed) over a fixed time.

However, the aforementioned controlling method is an extremely simple one in that the wheel is rotated at a high speed uniformly over Ty on condition that the point x is present in the dangerous timings $Td_1$, $Td_2$, . . . . Therefore, it cannot be said that no collision will occur between the bill and the blade in cases where the point x falls, for instance, within the intermediate timings $Tn_1$, $Tn_2$, . . . .

SUMMARY OF THE INVENTION

An object of the invention is to positively prevent the collision of a bill against a blade of the accumulating wheel.

To attain the aforementioned object, the present invention is arranged such that it is possible to obtain the time of deviation between a timing at which the passing of the bill through a specific position in a conveying passage for feeding the bill onto the accumulating wheel is detected on the one hand, and a timing at which the passing of a blade of the accumulating wheel through a specific position is detected on the other hand. From the times thus obtained, an appropriate rotating speed for allowing the accumulating wheel to be rotated to a position where the bill does not collide against the blade is calculated. The bill is then fed in while avoiding dangerous timings as the accumulating wheel is rotated at a rotating speed according to the results of the calculation. In other words, the arrangement is made so as to feed in the bill at the safest timing.

DESCRIPTION OF THE DRAWINGS

The present invention will now be described in detail with reference to the preferred embodiment illustrated in the accompanying drawings in which.

DESCRIPTION OF THE PREFERRED EMBODIMENT

Figure 1:
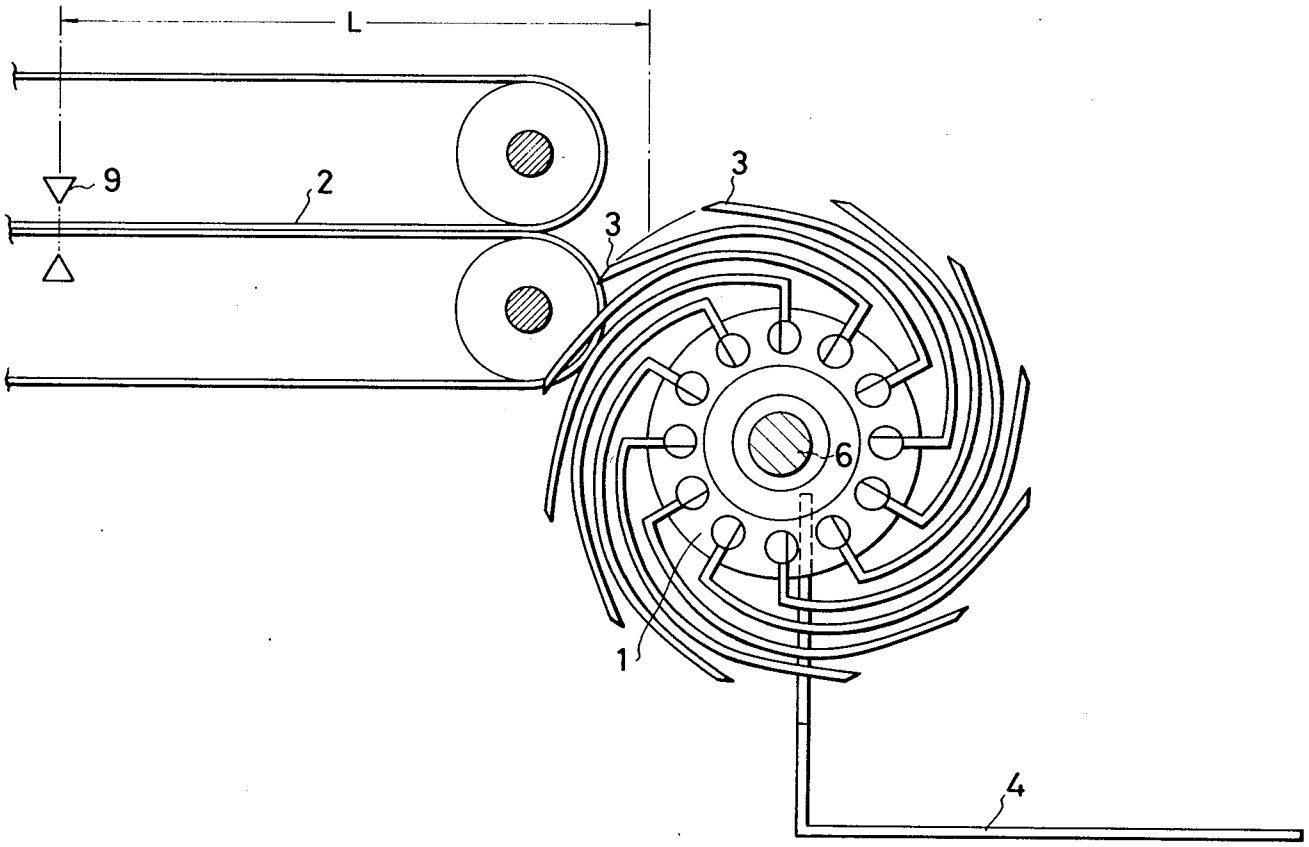
FIG. 1 is a side elevational view of an accumulating wheel and a conveying passage.

The present invention will be now described in detail by referring to the embodiment shown in the accompanying drawings.

First, a description will be made of the mechanical structure of the accumulating wheel with reference to FIGS. 1 to 3. The accumulating wheel 1 is provided at the terminating portion of a conveying passage 2. Bills fed out from the conveying passage 2, after being held between blades 3 of the accumulating wheel 1 and rotating in the clockwise direction as viewed in FIG. 1, drop onto an accumulating table 4 to be accumulated thereon. Additionally, two accumulating wheels 1 are installed on a shaft 6 driven by a drive motor 5 (a stepping motor is used in this embodiment) so as to rotate together with the shaft 6. This shaft 6 is provided with a rotary disk 8 for interrupting the optical path of an sensor 7 comprising a photo-sensor or the like in order to detect the rotating angle of a blade 3.

Figure 3:
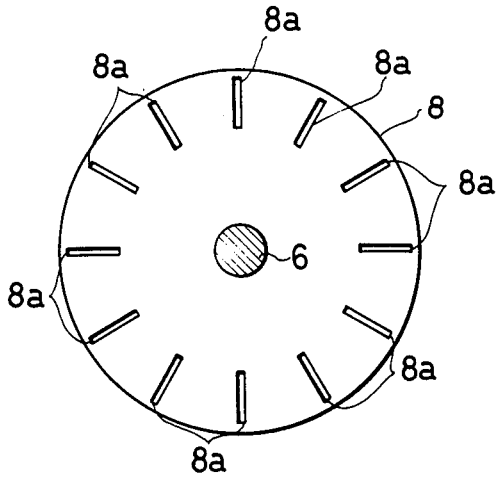
FIG. 3 is a top plan view of a rotary disk.

In other words, this rotary disk 8 is provided with N slits 8*a* corresponding to N blades 3 of the accumulating wheel 1 (refer to FIG. 3). The rotary disk 8 is positioned circumferentially relative to the blades of the accumulating wheel 1 so that slits 8*a* will intersect with an inspection beam of the sensor 7 at a timing at which a bill fed out from the conveying passage 2 is positively inserted between two blades 3, 3 of the accumulating wheel 1, for instance, at a timing at which an intermediate point between the two blades 3,3 intersects the bill feeding-out direction.

Figure 2:
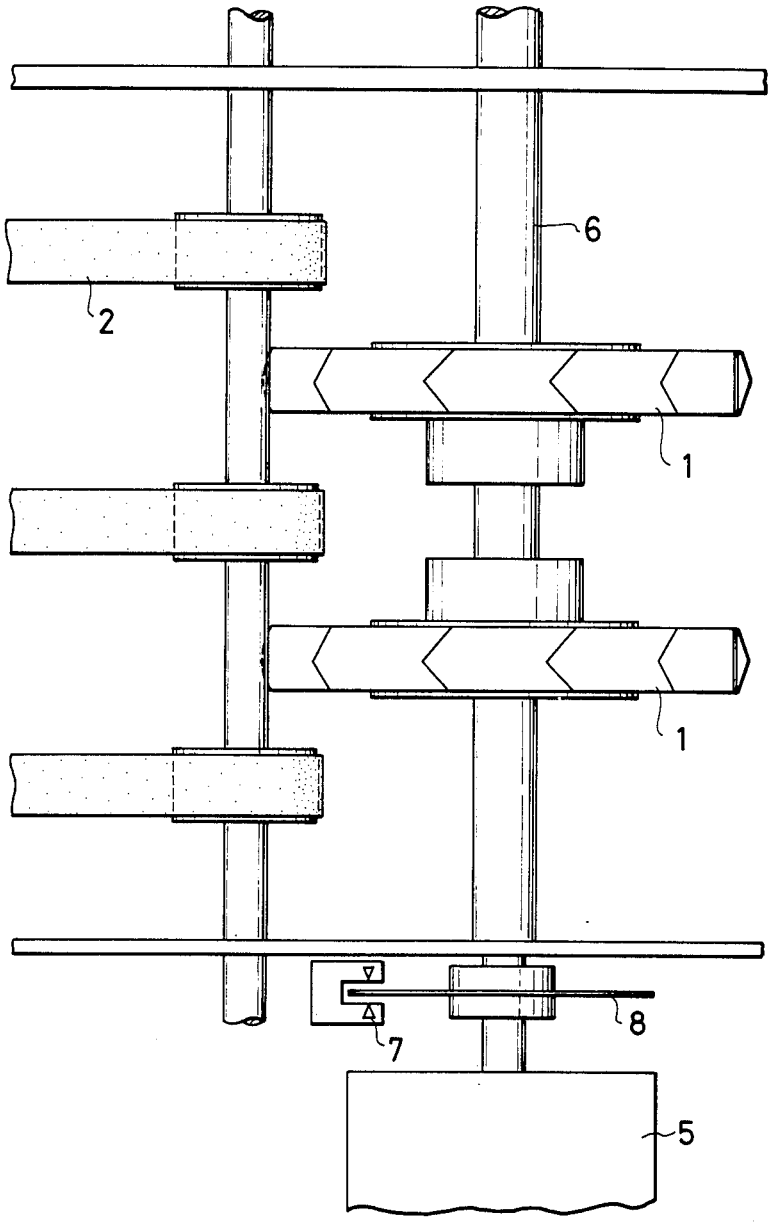
FIG. 2 is a top plan view of the parts shown in FIG. 1.

Furthermore, as shown in FIG. 1, a photo-sensor 9 is provided for detecting the passage of a bill in a position which is distant from the terminating portion of the conveying passage 2. The inspection beam of this photo-sensor 9 is arranged such that its beam is interrupted by the passing of the bill. The distance L between the rotating locus of the accumulating wheel 1 and the photo-sensor 9 is set to a dimension smaller than the conveying interval of the bills (a distance between a given bill and the ensuing bill in the conveying passage).

Next, a description will be made of a control circuit for adjusting the rotating speed of the accumulating wheel 1 on the basis of the detection data obtained from the sensor 7 and the photo-sensor 9.

Figure 4:
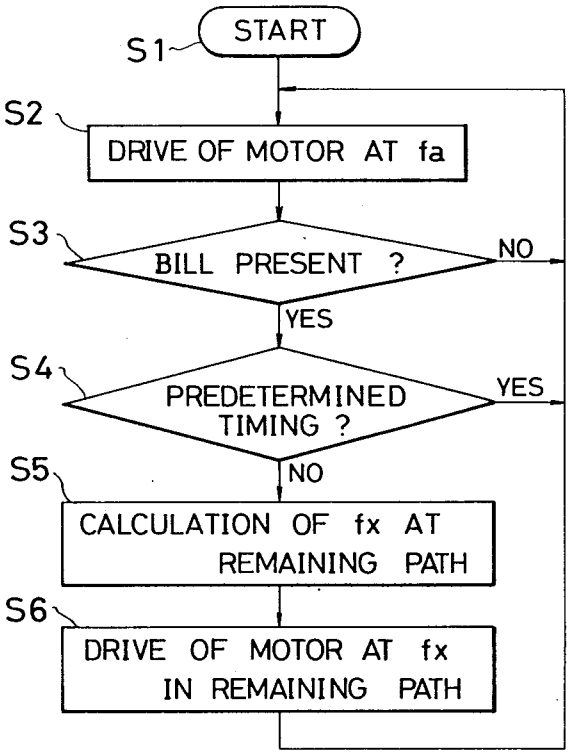
FIG. 4 is a flow chart illustrating the basic operation of a control circuit.

First, the basic principle of the control method applied to this control apparatus will be is explained with reference to the flow chart shown in FIG. 4.

$S_1$: Start.

$S_2$: The drive motor 5 is rotated at the normal rotating speed $\underline{fa}$ (a normal number of revolutions).

$S_3$: The operation proceeds to the next step on condition that the bill has passed the upper position of the photo-sensor (YES).

$S_4$: The timing at which the photo-sensor 9 detected the bill and the timing at which the sensor 7 detected the position of a blade 3 are calculated (by a formula to be described later) to judge whether or not it is a safe timing. The operation proceeds to the next step on condition that it is not a safe timing (in the case of NO).

$S_5$: A speed $\underline{fx}$ necessary for rotting the accumulating wheel 1 up to a safe rotating angle is calculated on the basis of the deviation between the output timings of the sensor 7 and the photo-sensor 9 (by a formula to be described later).

$S_6$: The drive motor 5 is rotated at the calculated speed $\underline{fx}$.

Then, the calculation of $\underline{fx}$ in the step $S_5$ in the aforementioned flow chart is carried out in accordance with the formula below.

In other words, assuming that the time (a count value) from the time when the sensor 7 detects the slit 8*a* and issues an H signal (a safe timing) until the photo-sensor 9 detects the passage of the bill is $\underline{Tx}$;

that the rotating angle at the time when the stepping motor rotates by one step is $\underline{\theta}$, and that the time from the bill's actuation of the photo-sensor 9 until the bill intersects the rotating locus of the tip of the blade 3 of the accumulating wheel 1 is $\underline{Tab}$ (in a case where the bill conveying speed in the conveying passage is $\underline{V}$, $\underline{Tab}=\underline{L}/\underline{V}$), the number of steps $\underline{\omega}$ necessary for the accumulating wheel 16 to rotate by an angle corresponding to the portion of one blade is obtained by the following formula:

$$\omega = 360 \div \theta \div N \qquad \text{Formula (I)}$$

Furthermore, assuming that the time necessary for the drive motor to rotate by one step is $\underline{T\theta}$, the number of steps $\underline{Y}$ necessary for rotating the accumulating wheel 1 from the time when the passage of the bill is confirmed up until the next safe timing (until an output from the sensor 7 is obtained) is given by the following formula:

$$\underline{Y} = \underline{\omega} = \underline{Tx} \div \underline{T\theta} \qquad \text{Formula (II)}$$

Therefore, the number of steps $\underline{z}$ necessary for rotating the accumulating wheel 16 up to a safe timing after skipping "n" number of safe timings can be given by the following formula:

$$\underline{z} = \underline{Y} + \underline{n\omega} \qquad \text{Formula (III)}$$

Accordingly, in order to effect rotation in the aforementioned number of steps within a limited time of $\underline{Tab}$, it becomes necessary to rotate the drive motor 5 of the accumulating wheel 1 at an average speed $\underline{F}$ given by the following formula:

$$\begin{aligned} \underline{F} &= \underline{Z} \div \underline{Tab} \\ &= (\underline{Y} + \underline{n\omega}) \div \underline{Tab} \end{aligned} \qquad \text{Formula (IV)}$$

Then, the rotating speed $\underline{R}$ (rpm) of the accumulating wheel 1 at this time is given by the following formula:

$$\underline{R} = \underline{F} \times \underline{\theta} \qquad \text{Formula (V)}$$

Furthermore, in the control apparatus of the present embodiment, the accumulating wheel 1 is rotated at a high speed over a fixed time using a high frequency having the relationship of "$\underline{fb}=2\underline{fa}$" in relation to a normal rotating speed fa so as to realize an average rotating speed obtained by Formula (IV) above. In other words, in the apparatus of the present embodiment, after passing through steps $S_{11}$–$S_{14}$ similar to $S_1$–$S_4$ shown in FIG. 4, the following steps are taken:

$S_{15}$: The number of steps necessary for rotating the accumulating wheel 1 up to a safe position is calculated.

$S_{16}$: To effect rotation by the aforementioned number of steps until the time when the bill which actuated the photo-sensor enters the rotating range of the accumulating wheel 1, the accumulation wheel 1 is rotated over a fixed time at a rotating speed twice the normal rotating speed.

Figure 6:
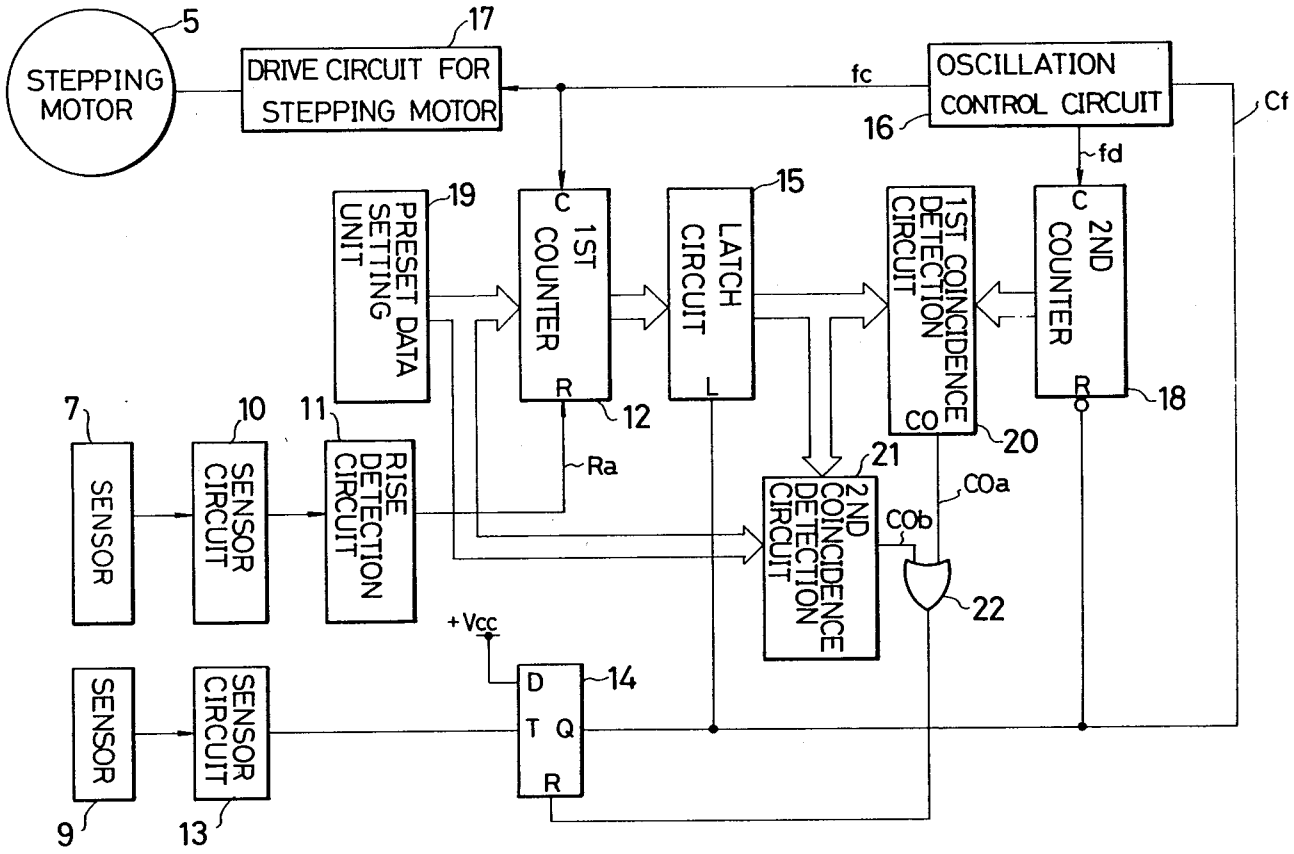
FIG. 6 is a block diagram of the control appratus.

A controlling apparatus for effecting control on the basis of this basic principle has such a specific arrangement as is shown in FIG. 6.

In other words, the detected signal of the sensor 7 is transmitted to a sensor circuit 10, which issues an H signal every time the beam of the sensor 7 is interrupted. The output signal of the sensor circuit 10 is inputted into a rise detection circuit 11, which inputs a reset signal Ra into the R (reset) input terminal of a first counter 12 every time the output of the sensor circuit 10 rises.

Meanwhile, the output signal of the sensor 9 is inputted into the senor circuit 13, which issues an H signal when the beam of the sensor 9 is interrupted. The output of this sensor circuit 13 is inputted into the T (trigger) input terminal of a delay flip-flop 14. Also, since a voltage Vcc is constantly applied to the D (data) input terminal of this delay flip-flop 14, the Q output terminal of the delay flip-flop 14 outputs an H signal from the Q output terminal every time the beam of the sensor 9 is intercepted. Moreover, the output of the Q output terminal is arranged such that it is reset and changed over to an L signal every time a reset signal is inputted into the R (reset) input terminal of the flip-flop 14.

Furthermore, a signal that issues from the Q output terminal of the flip-flop 14 is inputted into the L (load) input terminal of a latch circuit 15 whereby the count of the first counter circuit 12 is latched. At the same time, said signal is also used as a sensor actuating signal Cf for outputting an actuating pulse signal fc to the drive circuit 17 of the drive motor 5 by actuating an oscillation control circuit 16 (the specific arrangement of the oscillation control circuit will be described later), and is also inputted as a reset signal into the R (reset) input terminal of a second counter 18 which counts an fd signal issued from the oscillation control circuit 16.

Furthermore, the fc signal output from the oscillation control circuit 16 is connected to the C (count) input terminal of the first counter 12, which counts down the data input from a preset data setting unit 19 every time an fc signal is input. In addition, the count data stored in the first counter is latched every time a signal is input into the L input terminal of the latch circuit 15. Moreover, the latched signal is compared with the count value of the second counter 18 at a first coincidence detection circuit 20, while said data is compared with the input data of the preset data setting unit 19 at a second coincidence detection circuit 21. The output signals COa and COb of these first and second coincidence detection signals 20, 21 are input respectively into an OR gate 22 for resetting the delay flip-flop 14.

Figure 7:
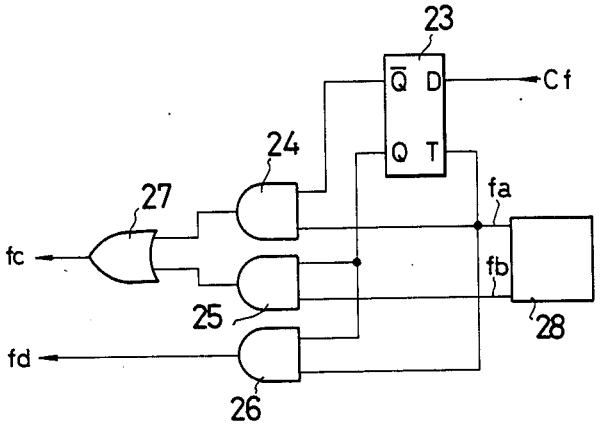
FIG. 7 is a block diagram of an oscillator control circuit.
Figure 5:
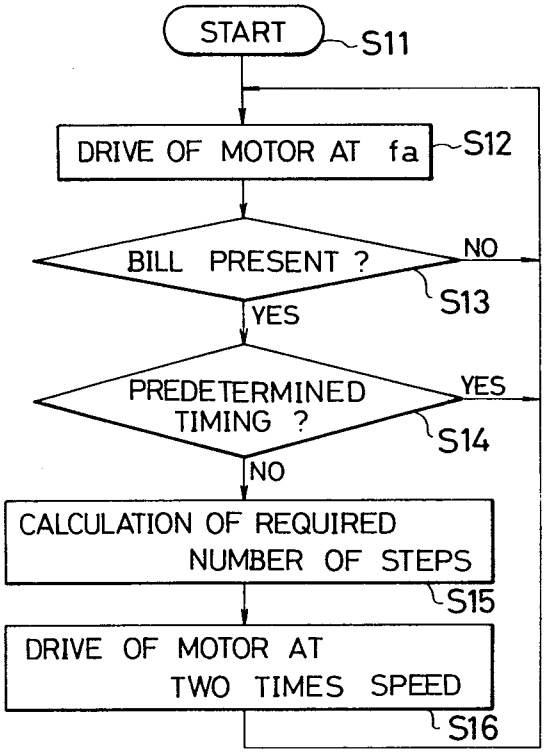
FIG. 5 is a flow chart illustrating the control operation of a control apparatus of the embodiment.

Next, the specific arrangement of the oscillation control circuit 16 will be described. As shown in FIG. 7, this circuit comprises a flip-flop 23, first to third AND gates 24, 25 and 26, an OR gate 27, and an oscillation 28. In this circuit, signals fa, fb of two types of frequency are issued by the oscillator 28 (the signals are set in the relationship of "fb=2fa" in this embodiment), and on condition that Cf is H, the circuit generates output signals of:

$$fc=fb$$

$$fd=fa$$

and, at the same time, on condition that Cf is L, the circuit generates output signals of:

$$fc=fa$$

$$fd=0.$$

The oscillator 28 of this embodiment generates two types of frequency: fa and fb, which is twice the fa frequency. Therefore, the oscillator 28 can be fabricated easily, for instance, by a very simple arrangement which combines an oscillator with a frequency of fb and a frequency demultiplier constituted by a flip-flop or the like.

Figure 8:
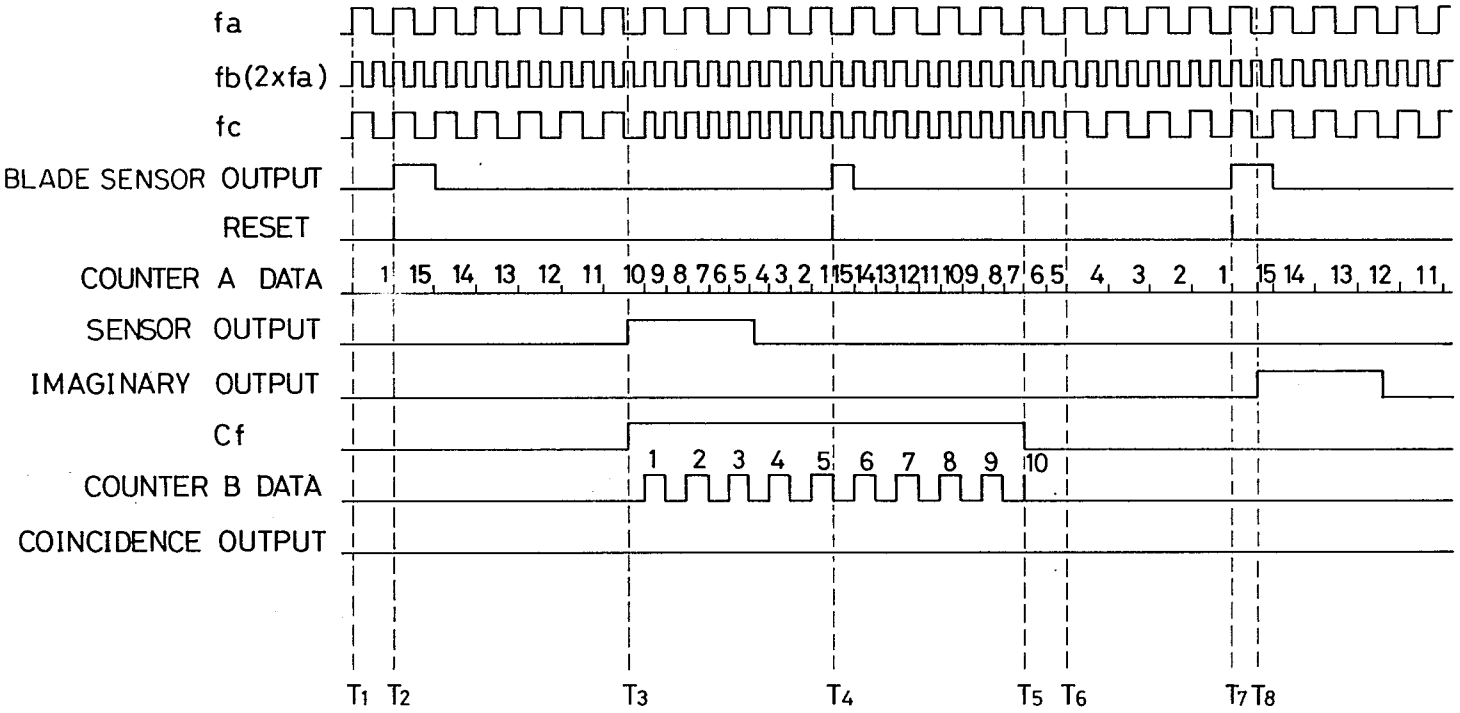
FIG. 8 is a timing chart showing the operation of the controlling circuit.

Next, description will be made of a operation for adjusting the timing by controlling the rotation of the accumulating wheel 1 by means of the aforementioned control apparatus with reference to a timing chart shown in FIG. 8. In the description that follows, the reference character Tn denotes one of a series of timings, the number combined with it representing the corresponding ordinal number (e.g., $Tn_1$="first timing").

$T_1$: Two types of frequency, fa, fb, are generated by the oscillator 28, and these signals cause the oscillation control circuit 16 to output a signal of "fc=fa," thereby causing the stepping motor drive circuit 17 to rotate the accumulating wheel at a frequency equivalent to fa. Meanwhile, the conveying passage 2 conveys the bill in conjunction with the rotation of the accumulating wheel 1.

$T_2$: When the sensor 7 detects the passage (a safe timing) through the slit 8*a*, the output of the sensor circuit 10 becomes H. Furthermore, the rise of this H signal is detected by the rise detection circuit 11, which in turn inputs a reset signal Ra into the R input terminal of the first counter 12, and count down is carried out every time fc is input. In this embodiment, a count value of 15 at the time when a bill is fed in at a safe timing is present as an initial value in the preset data setting unit 19, and count down is carried out from this initial value of 15. Additionally, if the accumulating wheel 1 rotates up to a position exceeding the safe timing, the output of the sensor 7 falls, but this fall exerts no effect on the operation of this apparatus.

$T_3$: When a bill passes a predetermined position in the conveying passage, the sensor 9 detects the same, an H signal is output from the sensor circuit 13, while an H signal is output from the Q output terminal of the delay flip-flop 14. The count value of the counter 12 is latched by the latch circuit 15 by this H signal, and, at the same time, the reset of the second counter 18 is released. Additionally, when a Cf signal is input into the D input terminal of the oscillation control circuit 16, a pulse of "fc=fb" is input into the drive circuit 17 so as to rotate the drive motor 5 at a high speed. Furthermore, a pulse of "fd=fa" is input into the second counter 18, and the second counter 18 counts this pulse. When the bill finishes passing above the sensor 9, the output of the sensor 9 falls, but this fall exerts no effect on the operation of this apparatus.

$T_4$: The sensor 7 detects the slit 8*a* again, and the first counter 12 is reset by this rise detection signal Ra to effect a count again. However, this count data is not latched by the latch circuit 15.

$T_5$: When coincidence of the count value of the second counter 18 with the stored value of the latch circuit 15 is detected by the coincidence detection circuit 20, the coincidence detection circuit 20 issues a coincidence output COa, which in turn sets the output signal of the OR gate 22 to H. Consequently, the delay flip-flop 14 is reset, and the Q output signal Cf becomes L.

$T_6$: With a rise in the Cf signal, the oscillation control circuit 16 is operated, and after two pulses of "fc=fb" are generated, the status of the signal becomes "fc=fa," with the result that the drive motor 5 assumes its normal operating status.

$T_7$: An H signal is output by the sensor 7 in conjunction with the rotation of the accumulating wheel 1, and the first counter 12 is reset, but exerts no effect on the operation of the accumulating wheel 12 and the like.

$T_8$: Assuming that a photo-sensor similar to the aforementioned sensor 9 is provided at a point of intersection between the bill and the rotating locus of the tip of the blade 3 of the accumulating wheel 1, and further assuming that the output of the sensor is H during the time when the bill is passing the point of intersection, the timing of a rise which takes place when this imaginary output becomes H is included in the range in which the output of the sensor 7 is H. Accordingly, the bill is fed in in the rotating range of the accumulating wheel 1 at a safe timing.

Thereafter, the operations of the above-described $T_1$ to $T_8$ are repeated every time an H output is generated by the sensor circuit 13 of the photo-sensor 9.

In a case where the timing at which the sensor 9 detects the bill is a safe one, the count value of the first counter 12 is latched when it is 15 at the time when the bill is detected by the sensor 9 and the Q output of the delay flip-flop 14 becomes H. Then, coincidence between the latched value and the set value 15 of the preset data setting unit 19 is detected by the coincidence detection circuit 21, and the delay flip-flop 14 is reset immediately. Consequently, since Cf remains L, the output signal fc of the oscillation control circuit 16 remains in the status of "$\underline{fc}=\underline{fa}$", with the result that the speed adjustment of the accumulating wheel 1 is not carried out.

Figure 9:
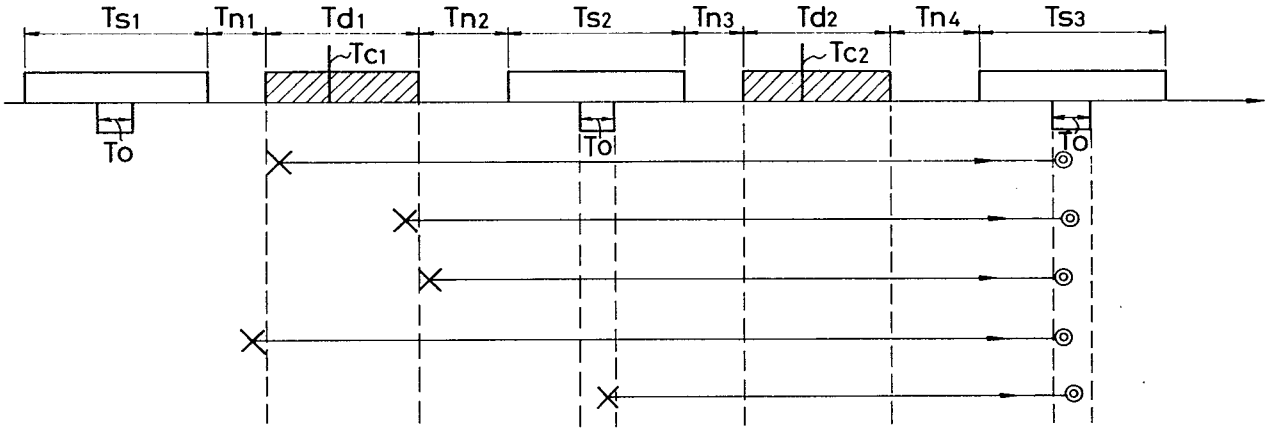
FIG. 9 is a diagram illustrating the relative relationship between the position of a bill and the rotating angle of the accumulating wheel.
Figure 10:
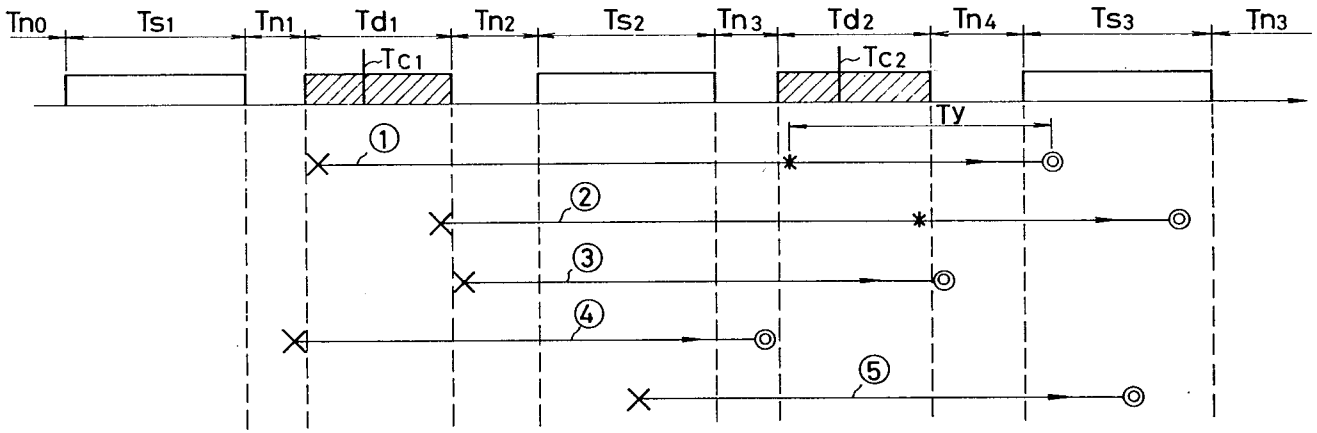
FIG. 10 PRIOR ART
FIG. 10 is a diagram illustrating the relative relationship between the position of a bill in a conventional controlling apparatus and the rotating angle of the accumulating wheel.

Accordingly, in the apparatus of this embodiment, as shown in FIG. 9, even in cases where the timing at which the bill passes above the photo-sensor falls in any of the safe timings $Ts_1$, $Ts_2$, $Ts_3$, . . . , dangerous timings $Td_1$, $Td_2$, $Td_3$, . . . , and intermediate timings $Tn_1$, $Tn_2$, $Tn_3$, . . . , the timing of the bill's entry into the rotating range of the accumulating wheel can be adjusted to an optimum timing $T_0$ for placing the bill substantially in the middle of a safe timing.

The arrangement of an apparatus to which the method relating to the present invention is applied is not restricted to the above-described embodiment, and, for instance, it is possible to make the arrangement as follows: A signal is issued by the sensor 7 at a dangerous timing (a timing at which the blade intersects the advancing direction of the bill) by deviating the relative positions of the blade of the accumulating wheel and the slit of the rotary disk, and the rotation of the drive motor can be controlled by detecting a safe timing from this dangerous timing as well as a signal issued by the photo-sensor. In addition, it goes without saying that the drive motor is not restricted to the pulse motor of the aforementioned embodiment, and that a variable motor of other type can be used.

As is apparent from the foregoing description, in the present invention, the timing at which the bill passes a specific position in the conveying passage and the tinming at which the accumulating wheel assumes a predetermined rotating angle are respectively detected, and the rotating speed of the accumulating wheel is adjusted on the basis of the deviation between these timings. The present invention, therefore, has the advantage that the collision between the bill and the blade can be prevented by means of a simple mechanism.

What is claimed is:

1. An apparatus for controlling the rotation of a bill accumulating wheel which is disposed downstream of a bill conveying passage to receive a bill therefrom between a pair of successive blades of the accumulating wheel, which comprises:

a first sensor for detecting the passage of the bill through a predetermined position in the conveying passage, a second sensor for detecting a blade and generating a detection signal corresponding to the rotating angle of the blade of the accumulating wheel, drive means for driving the accumulating wheel, a drive circuit for supplying a driving current to said drive means of the accumulating wheel, and a control circuit for detecting a difference in time between a time detected by the second sensor and a time detected by the first sensor and for operating the drive circuit to rotate said drive means at a speed required for rotating the blade of the accumulating wheel up to an angle at which the bill can be received between a pair of the blades, wherein said control circuit includes:

storing means (15) for digitally storing a difference between a preset value corresponding to an initial count value at the time when a bill is fed in at a safe timing and the lapse of time from the time when the blade is detected by the second sensor to the time when the bill is detected by the first sensor to generate an output corresponding to the difference, counting means (18) for digitally counting the lapse of time from the time when the bill was detected by the first sensor to the time when the count value of the counting means coincides with the difference stored in the storing means to generate an output, comparator means (20) for comparing the output of the counting means (18) with the output of the storing means (15) to detect the time when both outputs are coincident, and means (14, 16) for driving said drive means at a speed twice as fast as a normal speed during a period from the time when the bill was detected to the time when the coincidence of the outputs is detected by the comparator means.

2. An apparatus for controlling the rotation of a bill accumulating wheel according to claim 1, wherein said apparatus further comprises:

(a) means for defining a plurality of safe timing zones, each falling between successive blades as the accumulating wheel is rotated, the safe timing zones being less than the time intervals between the passage of successive blades and (b) means for defining an optimum timing zone within the safe timing zones and lying on each side of the midpoint of the safe timing zone, so that the bill enters the accumulating wheel at a point substantially midway between two successive blades.

3. An apparatus for controlling the rotation of a bill accumulating wheel according to claim 1, wherein said storing means includes a latch circuit.

4. An apparatus for controlling the rotation of a bill accumulating wheel according to claim 1, wherein said comparator means includes a coincidence detection circuit.

5. An apparatus for controlling the rotation of a bill accumulating wheel according to claim 1, wherein said means for driving includes a delay flip-flop and an oscillation control circuit.

* * * * *